US008834748B2

(12) United States Patent
Nordmann et al.

(10) Patent No.: US 8,834,748 B2
(45) Date of Patent: Sep. 16, 2014

(54) METHOD FOR MANUFACTURING TRANSPARENT CONDUCTING OXIDES

(76) Inventors: Gero Nordmann, Charlotte, NC (US); Norbert Wagner, Mutterstadt (DE); Alexander Traut, Mannheim (DE); Christian Bittner, Bensheim (DE); Ingo Münster, Böhl-Iggelheim (DE); Bernd Smarsly, Pohlheim (DE); Yude Wang, Potsdam (DE); Markus Antonietti, Nuthetal (DE); Simone Mascotto, Gieβen (DE)

( * ) Notice: Subject to any disclaimer, the term of this patent is extended or adjusted under 35 U.S.C. 154(b) by 799 days.

(21) Appl. No.: 12/995,043

(22) PCT Filed: May 25, 2009

(86) PCT No.: PCT/EP2009/056273

§ 371 (c)(1),
(2), (4) Date: Nov. 29, 2010

(87) PCT Pub. No.: WO2009/144186

PCT Pub. Date: Dec. 3, 2009

(65) Prior Publication Data

US 2011/0073814 A1 Mar. 31, 2011

(30) Foreign Application Priority Data

May 30, 2008 (EP) ..... 08157333

(51) Int. Cl.
*H01B 1/12* (2006.01)
*H01B 1/08* (2006.01)
*C23C 18/12* (2006.01)

(52) U.S. Cl.
CPC ..... *C23C 18/1254* (2013.01); *C23C 18/1216* (2013.01)
USPC .... 252/519.33; 428/142; 428/141; 427/126.1

(58) Field of Classification Search
USPC ..... 252/519.33; 427/126.1, 162; 428/141, 428/142
See application file for complete search history.

(56) References Cited

U.S. PATENT DOCUMENTS

| | | | |
|---|---|---|---|
| 7,498,386 | B2 | 3/2009 | Karl et al. |
| 2005/0234184 | A1 | 10/2005 | Doring et al. |

FOREIGN PATENT DOCUMENTS

| | | | |
|---|---|---|---|
| JP | 2005-060160 | A | 3/2005 |
| WO | WO-99/37705 | A1 | 7/1999 |
| WO | WO-2004/009654 | A1 | 1/2004 |
| WO | WO-2004/035635 | A1 | 4/2004 |
| WO | WO 2007/144322 | | 12/2007 |

OTHER PUBLICATIONS

Brezesinski et al, Angewandte Chemie International Edition, vol. 45, Issue 5, pp. 781-784, published online: Dec. 21, 2005.*
Ordered Mesoporous Sb-, Nb-, and Ta-Doped SnO2 Thin Films with Adjustable Doping Levels and High Electrical Conductivity, Brezesinski et al. (ACS Nano, 2009, 3 (6), pp. 1373-1378).*
Brezesinski et al., Advanced Functional Materials, 2006, 16, 1433-1440.
Fattakhova-Rohfing et al., Advanced Materials, 2006, 18, 2980-2983.
Groenewolt et al., Advanced Materials, 2005, 17, 1158-1162.
Zhang J et al: "Si-gel preparation of poly(ethylene glycol) doped indium tin oxide thin films for sensing applications" Optical Materials, Elsevier Science Publishers B V Amsterdam, NL, Bd 26, Nr1, Jun. 1, 2004, pp. 47-55.

* cited by examiner

*Primary Examiner* — Mark Kopec
*Assistant Examiner* — Haidung Nguyen
(74) *Attorney, Agent, or Firm* — Drinker Biddle & Reath LLP

(57) ABSTRACT

The present invention relates to a process for preparing transparent conductive oxides, comprising the following steps in the sequence of a-b-c:
(a) reaction of
at least one starting compound (A) comprising at least one metal or semimetal M
and optionally of a dopant (D) comprising at least one doping element M', where at least one M' is different than M,
in the presence of a block copolymer (B) and of a solvent (C) to form a composite material (K),
(b) optional application of the composite material (K) to a substrate (S) and
(c) heating of the composite material (K) to a temperature of at least 350° C.,
wherein the block copolymer (B) comprises at least one alkylene oxide block (AO) and at least one isobutylene block (IB).
The present invention further relates to the transparent conductive oxides thus obtainable, and to their use in electronic components, as an electrode material and as a material for antistatic applications. The present invention finally relates to electronic components comprising the transparent conductive oxides.

23 Claims, No Drawings

METHOD FOR MANUFACTURING TRANSPARENT CONDUCTING OXIDES

CROSS-REFERENCE TO RELATED APPLICATIONS

This application is a national stage application (under 35 U.S.C. §371) of PCT/EP2009/056273, filed May 25, 2009, which claims benefit of European application 08157333.9, filed May 30, 2008. The contents of each of the foregoing applications are incorporated herein by reference in their entireties.

FIELD OF THE INVENTION

The present invention relates to a process for preparing transparent conductive oxides, comprising the following steps in the sequence of a-b-c:

(a) reaction of at least one starting compound (A) comprising at least one metal or semimetal M and optionally of a dopant (D) comprising at least one doping element M', where at least one M' is different than M, in the presence of a block copolymer (B) and of a solvent (C) to form a composite material (K), (b) optional application of the composite material (K) to a substrate (S) and (c) heating of the composite material (K) to a temperature of at least 350° C., wherein the block copolymer (B) comprises at least one alkylene oxide block (AO) and at least one isobutylene block (IB).

The present invention further relates to the transparent conductive oxides thus obtainable, and to their use in electronic components, as an electrode material and as a material for antistatic applications. The present invention finally relates to electronic components comprising the transparent conductive oxides.

BACKGROUND

Conductive transparent layers are of great significance for applications in electronics and optoelectronics, for example in displays, electronic paper, solar cells, touch panels and as an electrode. To date, owing to good electrical conductivity and established industrial implementation, principally tin-doped indium oxide (ITO) and in some cases also fluorine-doped $SnO_2$ (FTO) have been used, which are typically applied to the substrates by means of costly and inconvenient application technology (sputtering). Another great disadvantage is the high costs for indium.

In the coating of polymeric substrates, the adhesion of the layers is additionally critical. Layers of transparent conductive oxides (TCOs) applied to substrates by chemical vapor deposition (CVD) are generally very brittle and therefore become detached very easily from thin substrates, for example polymer or glass. TCO layers produced in this way also have a marked surface roughness, which is disadvantageous especially in components with several layers and in the case of layer thicknesses in the region of 100 nm or less (for example OLEDs).

The production of transparent conductive oxides (TCOs) by means of sol-gel processes and generation of corresponding layers has been proposed as a possible solution to the above-described problems. The mesoporous structure required is generated in the prior art typically by templating, using structure-forming components, for example nonionic surfactants, to control or influence the mesostructure.

However, a disadvantage in the known processes is that the crystallinity, which is a prerequisite for high conductivities, of the layers applied to substrates, for example by dip-coating, has to be increased by calcining at high temperature, which frequently leads to crack formation and detachment of the films from the substrates.

JP 2005-060160 A describes the production of mesoporous films proceeding from metal halides by templating by means of polyoxyethylene stearyl ether and subsequent aging in a steam atmosphere below 100° C. However, a disadvantage is the complicated and time-consuming process and especially the very low crystallinity and conductivity, and also the stability of the mesostructure of the TCO thus obtainable, which is insufficient at high temperatures.

WO document 99/37705 discloses that mesoscopically ordered oxide-block copolymer composites and mesoporous metal oxide films can be obtained by using amphiphilic block copolymers in aqueous medium, which function as structuring agents by self-assembly. The block copolymers used are alkylene oxide block copolymers and EO-PO-EO triblock copolymers. The pore sizes thus obtained are up to 14 nm. The oxides described include $TiO_2$, $ZrO_2$, $SiO_2$, $Al_2O_3$, $SnO_2$. Conductive transparent oxides are not mentioned. When said alkylene oxide block copolymers are used, a destruction of the mesostructure during the thermal treatment, if at all, can be prevented only by complicated temperature programs. An additional disadvantage is the low crystallinity of the nonstoichiometric oxides. The process of WO 99/37705 additionally proceeds in the presence of water and does not lead to thin layers with homogeneous layer thickness for transition metal oxides.

The publication of Brezesinski et al., Advanced Functional Materials 2006, 16, 1433-1440 describes the use of poly (ethylene-co-butylene)-block-poly(ethylene oxide) as a template (in the context of so-called EISA, evaporation-induced self-assembly) for the formation of the mesostructure in the production of mesoporous highly crystalline thin layers of $SnO_2$.

Fattakhova-Rohlfing et al., Advanced Materials 2006, 18, 2980-2983 describe the preparation of transparent indium tin oxide (ITO) by means of EISA in conjunction with poly (ethylene-co-butylene)-block-poly(ethylene oxide) as a structuring agent in a sol-gel process. However, a disadvantage is the limited dissolution behavior of poly(ethylene-co-butylene)-block-poly(ethylene oxide), which requires the presence of high amounts of tetrahydrofuran (THF) and can lead to incompatibility with regard to the solubility of the constituents of the reacting compounds, especially in complex mixtures. The processes described in the publications cited are unsuitable for the preparation of numerous TCOs, especially of antimony-doped tin oxide. In addition, the low mean pore size of the TCOs thus obtainable leads to a reduced stability during crystallization at high temperatures.

The use of block copolymers comprising a polyethylene oxide block and an isobutylene oxide block for templating in the preparation of mesostructured silicon dioxide and titanium dioxide is known from the publication of Groenewolt et al., Advanced Materials 2005, 17, 1158-1162. This describes the use of $PIB_{85}$-$PEO_{79}$ for preparing mesoporous silicon dioxide by a sol-gel process proceeding from TMOS, and mesoporous $TiO_2$ proceeding from $TiCl_4$. The diblock copolymer has a structure-forming function as a result of self-assembly. However, the publication does not disclose the preparation of transparent conductive oxides.

BRIEF SUMMARY OF THE INVENTION

It was therefore an object of the present invention to provide a process which makes it possible to obtain transparent conductive oxides (TCOs), including antimony-doped tin oxide, by a sol-gel process. The corresponding films composed of transparent conductive oxides should have a high electrical conductivity and a high homogeneity with regard to the layer thickness. The process should make it possible to obtain transparent conductive oxides with high crystallinity.

It was a further object of the present invention to make it possible to obtain mesoporous transparent conductive oxides whose mesostructure has a high stability even at high temperatures. Accordingly, the transparent conductive oxides obtainable should be stable during the crystallization. The pore size distribution should be narrow.

It was a further object of the present invention to make it possible to obtain transparent conductive oxides as thin layers. In addition, the films should have good adhesion to a substrate and a homogeneous layer thickness in the context of customary application processes such as dip-coating. The layer thickness should additionally be adjustable precisely within the range from approx. 10 nm to approx. 500 nm. The films thus obtainable should exhibit a high transparency.

The process should substantially prevent an adverse alteration to the mesostructure during the crystallization. More particularly, the formation of macroscopic cracks and detachment from the substrate during the crystallization should be prevented.

These objects are achieved by the process according to the invention and by the transparent conductive oxides thus obtainable.

DETAILED DESCRIPTION OF THE PREFERRED EMBODIMENTS

Preferred embodiments are explained in detail in the claims and in the description which follows. Combinations of preferred embodiments, especially combinations of preferred embodiments of individual process steps, do not leave the scope of the present invention.

The process according to the invention for preparing transparent conductive oxides will be illustrated in detail hereinafter.

Transparent conductive oxides are known to those skilled in the art as a substance class. The term "transparent conductive oxides" in the context of the present invention denotes metal oxides which may be doped and/or may comprise extraneous atoms, and which satisfy the following criteria:

- transmission at least 50% at a layer thickness of 100 nm and at a wavelength in the range from 380 nm to 780 nm to DIN 1349-2:1975;
- electrical conductivity at least 0.1 $S \cdot cm^{-1}$ to DIN EN ISO 3915.

The transparent conductive oxide is preferably additionally mesoporous. The term "mesoporous" in the context of the present invention is used in the sense of the IUPAC definition. A mesoporous structure is characterized by a number-weighted mean pore diameter of from 2 to 50 nm.

In the context of the present invention, the term "pore diameter" indicates the greatest diameter through the geometric center of a pore. The number-weighted mean pore diameter is determined by means of transmission electron microscopy (TEM) and subsequent image analysis evaluation using at least 500 pores of a statistically representative sample.

The number-weighted mean pore size of the transparent conductive oxides obtainable in accordance with the present invention is preferably from 10 to 45 nm, more preferably from 15 to 40 nm, especially from 20 to 35 nm.

The mesoporous transparent conductive oxides preferred in accordance with the present invention may comprise both closed-cell and open-cell pores. Open-cell pores are capable of sorbing Kr in an adsorption measurement. The pores may have different geometry. In many cases, approximately spherical pores or pores of ellipsoidal form have been found to be suitable. The number-weighted mean aspect ratio of the pores according to TEM is especially in the range from 1 to 4. When the mesoporous transparent conductive oxides are present as a thin layer having a layer thickness in the range of 500 nm or less, an aspect ratio of from 1.2 to 3 is preferred.

The transparent conductive oxides of the present invention are preferably crystalline. "Crystalline" in the context of the present invention means that the proportion by mass of crystalline transparent conductive oxide relative to the total mass of transparent conductive oxide is at least 60%, preferably at least 70%, more preferably at least 80%, especially at least 90%, determined by means of X-ray diffraction (XRD).

In the context of the present invention, the crystallinity is determined by means of X-ray diffraction. In this case, the crystalline portion of the scattering is determined as a ratio to the total scatter of the sample.

The transparent conductive oxide is preferably selected from the group consisting of doped binary oxides and ternary oxides, where the ternary oxides may be doped.

Step (a)

According to the invention, step (a) involves a reaction of at least one starting compound (A) comprising at least one metal or semimetal M and optionally of a dopant (D) comprising at least one doping element M', where at least one M' is different than M. This reaction is effected in the presence of a block copolymer (B) and of a solvent (C) to form a composite material (K).

A composite material is a material which has both an inorganic constituent and an organic constituent. In the present case, the composite material is an oxidic network or an oxidic network which also comprises reactive groups from the starting compound (A) or hydroxyl groups which are bonded to M, the oxidic network preferably having a mesostructure. The oxidic network is in contact with the block copolymer (B) which, in step (a), functions preferably as an agent which influences the structure, especially the mesostructure, especially as a template.

The starting compounds (A) used may in principle be all compounds comprising M, which can be converted to oxidic systems by hydrolysis (sol-gel process).

Preferred starting compounds (A) are chlorides, acetates, alkoxides, alkoxychlorides, nitrates, sulfates, bromides and iodides of M, and complexes of M with bidentate ligands. When the metal or semimetal M used is a transition metal, it is also possible to use complexes thereof with acetylacetonate or cyclooctadiene as the ligand. The starting compound (A) used is preferably at least one metal halide, metal alkoxide or a metal acetate.

Such starting compounds are known to those skilled in the art. Hydrolysis and condensation form oxidic systems which consist essentially of the appropriate metal or semimetal. The oxidic systems obtained after step (a) may also comprise further groups, especially OH groups, and water (so-called oxide hydrates).

The at least one metal or semimetal M is preferably selected from Sn, Zn, In and Cd.

In a preferred embodiment, the process according to the invention comprises the reaction of at least one starting compound (A) comprising at least one metal or semimetal M and of a dopant (D) comprising at least one doping element M', where at least one M' is different than M, in the presence of a block copolymer (B) and of a solvent (C) to form a composite material (K).

In the context of the present invention, a dopant is understood to mean an agent which leads to doping of the conductive transparent oxide. The term "doping" should be interpreted widely. It comprises both doping in the narrow sense, where the transparent conductive oxide comprises from 0.1 to 100 ppm of extraneous atoms as a result of the doping, and—this is especially preferred—doping in a wider sense, according to which the transparent conductive oxide is a mixed oxide which comprises the component which originates from the starting compound (A) to an extent of at least 50% by weight, preferably at least 70% by weight, especially at least 85% by weight. Accordingly, it is preferred when the inventive transparent conductive oxides comprise from 0.001 to 30% by weight, preferably from 0.01 to 20% by weight, especially from 0.1 to 15% by weight, of at least one metal M', based on 100% by weight of all metals M and M'.

Dopants for doping oxides of metals or semimetals are known to those skilled in the art. The person skilled in the art selects a suitable dopant depending on the starting compound (A) and depending on the transparent conductive oxide to be prepared. The person skilled in the art is aware that the use of dopants leads to so-called mixed oxides which, especially in the case of binary oxides, can in many cases lead to an increase in the electrical conductivity.

Useful doping elements M' include both metals or semimetals and nonmetals. "Doping element" in the context of the present invention is understood to mean that or those element(s) of the dopant (D) which is/are incorporated into the oxidic network as extraneous atoms.

When the doping element M' is a nonmetal, the reaction in step (a) is effected in the presence of a dopant (D) comprising a doping element M' selected from F, Cl, Br and I, particular preference being given to F.

If a dopant (D) comprising a metal or semimetal as the doping element M' is used, preference is given to a doping element M' selected from Al, Ga, B, Sb, Sn, Cd, Nb, Ta and In.

When the doping element M' is a metal or semimetal, preferred dopants (D) are chlorides, acetates, alkoxides, alkoxy chlorides, nitrates, sulfates, bromides, iodides of M', or complexes with bidentate ligands of M'. When M' is a transition metal, it is also possible to use complexes of M' with acetylacetonate or cyclooctadiene as the ligand. If the doping element M' is fluorine, preference is given to $CaF_2$, NaF, $NH_4F$ and $NR_4F$, where R is an organic radical, preferably an alkyl radical having from 1 to 8 carbon atoms.

The transparent conductive oxides obtainable in accordance with the invention are preferably selected from the group consisting of ATO (Sb-doped tin oxide), ITO (Sn-doped indium oxide, Nb- and Ta-doped $SnO_2$, F:ZnO, Al:ZnO, Ga:ZnO, B:ZnO, In:ZnO, F:SnO2, $Cd_2SnO_4$, $Zn_2SnO_4$, $MgIn_2O_4$, $CdSb_2SnO_6$:Y, $ZnSnO_3$, $GaInO_3$, $Zn_2In_2O_5$, $GaInO_3$, $In_4Sn_3O_{12}$, $SnO_2$, $WO_3$, $CeO_2$, aluminum oxide, iron oxide of the formula $FeO_x$ where x may assume a value of from 1 to 1.5, and $SrTiO_3$.

In a particularly preferred embodiment, the starting compound (A) comprises tin as the metal or semimetal M, and the dopant (D) comprises antimony as the doping element M'. The transparent conductive oxide obtainable in accordance with the invention is most preferably antimony-doped tin oxide.

Block Copolymer B

According to the invention, the block copolymer (B) comprises at least one alkylene oxide block (AO) and at least one isobutylene block (IB).

The individual blocks of the block copolymer (B) are joined to one another by means of suitable linking groups.

The linking groups may be either functional organic groups or individual atoms. Typically, the linking groups used are those which lead to a linear linkage. The linking groups may also have three or more than three linkage sites and thus lead to star-shaped block copolymers.

In practical terms, the linkage is effected typically by functionalizing polyisobutylene and then reacting with alkylene oxide or alkylene oxide blocks. Preferred functionalized polyisobutylenes and preferred preparation methods for the block copolymers (B) used in accordance with the invention are described below.

The alkylene oxide blocks (AO) and the isobutylene oxide blocks (IB) may each independently be linear or else have branches. They are preferably each linear.

The (IB) and/or (AO) blocks may be arranged terminally, i.e. be connected only to one other block, or else they may be connected to two or more other blocks. The (IB) and (AO) blocks may, for example, be joined to one another in alternating arrangement with one another in a linear manner. In principle, any number of blocks can be used. In general, however, not more than 8 (IB) and (AO) blocks in each case are present. This results in the simplest case in a diblock copolymer of the general formula AB. The copolymers may also be triblock copolymers of the general formula ABA or BAB. It is of course also possible for several blocks to follow one another in succession, for example ABAB, BABA, ABABA, BABAB or ABABAB.

In addition, the copolymers may be star-shaped and/or branched block copolymers or else comblike block copolymers in which, in each case, more than two (IB) blocks are bonded to one (AO) block or more than two (AO) blocks are bonded to one (IB) block. For example, the copolymers may be block copolymers of the general formula $AB_m$ or $BA_m$, where m is a natural number ≥3, preferably from 3 to 6 and more preferably 3 or 4. Of course, it is also possible for a plurality of A and B blocks to follow one another in the arms or branches, for example $A(BA)_m$ or $B(AB)_m$.

Such block copolymers (B) are known to those skilled in the art or can be prepared by means of known processes.

Preferably, the block copolymer (B) comprises at least one alkylene oxide block (AO) and at least one isobutylene block (IB), where the number-weighted mean block length of the alkylene oxide block or blocks (AO) is from 4 to 300 monomer units and the number-weighted average block length of the isobutylene block or blocks (IB) is from 5 to 300 monomer units.

Preferably, the reaction in step (a) of the process according to the invention is performed in the presence of at least one diblock copolymer (B) consisting of an alkylene oxide block (AO) and an isobutylene block (IB), i.e. the block copolymer (B) is a diblock copolymer of the general structure AO-IB.

The number-weighted mean block lengths of the alkylene oxide blocks (AO) and of the isobutylene blocks (IB) in the aforementioned block copolymers (B) are each independently more preferably from 10 to 300 monomer units, especially from 20 to 250 monomer units, most preferably from 30 to 200 monomer units. The number-weighted mean block length (via number-average molecular weight Mn) of the isobutylene blocks (IB) used and the number-average molecular weight Mn of the block copolymer obtained are determined in each case by means of gel permeation chromatography (GPC) with THF as the eluent against a polystyrene standard with a highly crosslinked styrene-divinylbenzene resin as the stationary phase. The number-weighted mean block length of the alkylene oxide blocks (AO) is determined therefrom by methods known to those skilled in the art.

In a particularly preferred embodiment, the number-weighted mean block length of the isobutylene blocks (IB) is from 90 to 200 monomer units and the number-weighted mean block length of the alkylene oxide blocks (AO) from 80 to 200 monomer units. The block copolymer (B) is most preferably a diblock copolymer of the general structure AO-IB. The person skilled in the art determines preferred number-weighted mean molecular weights from the aforementioned preferred block lengths by conversion using the known molecular weight of a monomer unit.

It has been found to be advantageous when the block copolymer (B) is of inhomogeneous structure with regard to its molecular weight. Without being restricted to the validity of theoretical considerations, there is the perception that block copolymer molecules with comparatively low molecular weight behave as a surface-active assistant synergistically to the block copolymer molecules with a comparatively high molecular weight, thus promoting the formation of the mesostructure.

It is preferred that the polydispersity index (PDI) of the block copolymer (B), which is defined as the ratio of weight-average and number-average molecular weight $M_w/M_n$, is from 1.2 to 30, more preferably from 1.5 to 25, especially preferably from 2 to 20, most preferably from 4 to 15. In particular, it has been found to be advantageous, in the case of block copolymers with a high mean molecular weight, simultaneously to use those with a high PDI. Accordingly, it is most preferred when the number-weighted mean block length of the isobutylene blocks (IB) in the block copolymer (B) is from 90 to 200 monomer units, and the number-weighted mean block length of the alkylene oxide blocks (AO) is from 80 to 200 monomer units, and the PDI of the block copolymer (B) is from 4 to 20.

The PDI of the block copolymer (B) is determined as Mw/Mn by means of gel permeation chromatography (GPC) with THF as the eluent against a polystyrene standard with a highly crosslinked styrene-divinylbenzene resin as the stationary phase. The determination of the polydispersity index (PDI) is described in general form, for example, in Analytiker-Taschenbuch [Analyst's Handbook], Volume 4, page 433 to 442, Berlin 1984.

The isobutylene blocks (IB) are referred to as such when the repeat units of the polymer block are at least 80% by weight, preferably at least 90% by weight, isobutene units, not counting the end groups and linking groups among the repeat units.

The isobutylene blocks (IB) are obtainable by polymerizing isobutene. However, the blocks may also comprise other comonomers as structural units to a minor degree. Such structural units can be used for fine control of the properties of the block. Comonomers which should be mentioned are, as well as 1-butene and cis- or trans-2-butene, especially isoolefins having from 5 to 10 carbon atoms such as 2-methyl-1-butene-1, 2-methyl-1-pentene, 2-methyl-1-hexene, 2-ethyl-1-pentene, 2-ethyl-1-hexene and 2-propyl-1-heptene, or vinylaromatics such as styrene and α-methylstyrene, $C_1$-$C_4$-alkylstyrenes such as 2-, 3- and 4-methylstyrene, and 4-tert-butyistyrene. The proportion of such comonomers should, however, not be too great. In general, the amount thereof should not exceed 20% by weight based on the amount of all structural units of the block. The blocks may, as well as the isobutene units and comonomers, also comprise the initiator or starter molecules used to start the polymerization or fragments thereof. The polyisobutylenes thus prepared may be linear, branched or star-shaped. They may have functional groups only at one chain end or else at two or more chain ends.

The starting materials for the preparation of block copolymers (B) comprising isobutylene blocks (IB) are preferably functionalized polyisobutylenes. Functionalized polyisobutylenes can be prepared proceeding from reactive polyisobutylenes, by providing them with functional groups in single-stage or multistage reactions known in principle to those skilled in the art. Reactive polyisobutylene is understood by those skilled in the art to mean polyisobutylene which has a high proportion of terminal alpha-olefin end groups. The preparation of reactive polyisobutylenes is likewise known and is described, for example, in detail in WO 04/9654, pages 4 to 8, and in WO 04/35635, pages 6 to 10.

Preferred embodiments of the functionalization of reactive polyisobutylene comprise:

i) reaction with aromatic hydroxyl compounds in the presence of an alkylation catalyst to obtain aromatic hydroxyl compounds alkylated with polyisobutylenes,
ii) reaction of the polyisobutylene block with a peroxy compound to obtain an epoxidized polyisobutylene,
iii) reaction of the polyisobutylene block with an alkene which has a double bond substituted by electron-withdrawing groups (enophile), in an ene reaction,
iv) reaction of the polyisobutylene block with carbon monoxide and hydrogen in the presence of a hydroformylation catalyst to obtain a hydroformylated polyisobutylene,
v) reaction of the polyisobutylene block with a phosphorus halide or a phosphorus oxychloride to obtain a polyisobutylene functionalized with phosphone groups,
vi) reaction of the polyisobutylene block with a borane and subsequent oxidative cleavage to obtain a hydroxylated polyisobutylene,
vii) reaction of the polyisobutylene block with an $SO_3$ source, preferably acetyl sulfate or oleum, to obtain a polyisobutylene with terminal sulfonic acid groups,
viii) reaction of the polyisobutylene block with nitrogen oxides and subsequent hydrogenation to obtain a polyisobutylene with terminal amino groups.

With regard to all details of the performance of the reactions mentioned, we refer to the remarks in WO 04/35635, pages 11 to 27.

Particular preference is given to embodiment i), particular preference being given to phenol as the aromatic hydroxyl compound, and to embodiment iii). In the context of iii), very particular preference is given to using maleic anhydride for the reaction. This results in polyisobutenes functionalized with succinic anhydride groups (polyisobutenylsuccinic anhydride, PIBSA).

The alkylene oxide blocks (AO) are referred to as such when the repeat units of the polymer block are at least 70% by weight, preferably at least 80% by weight, alkylene oxide units, not counting the end groups and linking groups among the repeat units.

Alkylene oxide units are, in a manner known in principle, units of the general formula —$R^1$—O—. In this formula, $R^1$ is a divalent aliphatic hydrocarbon radical which may optionally have further substituents. Additional substituents on the $R^1$ radical may especially be O-containing groups, for example >C═O groups or OH groups. An alkylene oxide block (AO) may of course also comprise several different alkyleneoxy units.

The alkylene oxide units may especially be —$(CH_2)_2$—O—, —$(CH_2)_3$—O—, —$(CH_2)_4$—O—, —$CH_2$—$CH(R^2)$—O—, —$CH_2$—$CHOR^3$—$CH_2$—O—, where $R^2$ is an alkyl group, especially $C_1$-$C_{24}$-alkyl, or an aryl group, especially phenyl, and $R^3$ is a group selected from the group of hydrogen, $C_1$-$C_{24}$-alkyl, $R^1$—C(═O)— and $R^1$—NH—C(═O)—.

The alkylene oxide blocks (AO) may also comprise further structural units, for example ester groups, carbonate groups or amino groups. They may further also comprise the initiator or starter molecules used to start the polymerization, or fragments thereof. Examples comprise terminal $R^2$—O— groups where $R^2$ is as defined above.

The alkylene oxide blocks (AO) preferably comprise, as main components, ethylene oxide units —$(CH_2)_2$—O— and/or propylene oxide units —$CH_2$—$CH(CH_3)$—O, while higher alkylene oxide units, i.e. those having more than 3 carbon atoms, are present only in minor amounts for fine adjustment of the properties. The blocks may be random copolymers, gradient copolymers, alternating copolymers or block copolymers composed of ethylene oxide and propylene oxide units. The amount of higher alkylene oxide units should not exceed 10% by weight, preferably 5% by weight. They are preferably blocks which comprise at least 50% by weight of ethylene oxide units, preferably 75% by weight and more preferably at least 90% by weight of ethylene oxide units. They are most preferably pure polyoxyethylene blocks (AO).

The alkylene oxide blocks (AO) are obtainable in a manner known in principle, for example by polymerizing alkylene oxides and/or cyclic ethers having at least 3 carbon atoms and optionally further components. They can additionally also be prepared by polycondensing di- and/or polyalcohols, suitable starters and optionally further monomeric components.

Examples of suitable alkylene oxides as monomers for the alkylene oxide blocks (AO) comprise ethylene oxide and propylene oxide, and also 1-butene oxide, 2,3-butene oxide, 2-methyl-1,2-propene oxide (isobutene oxide), 1-pentene oxide, 2,3-pentene oxide, 2-methyl-1,2-butene oxide, 3-methyl-1,2-butene oxide, 2,3-hexene oxide, 3,4-hexene oxide, 2-methyl-1,2-pentene oxide, 2-ethyl-1,2-butene oxide, 3-methyl-1,2-pentene oxide, decene oxide, 4-methyl-1,2-pentene oxide, styrene oxide or a mixture of oxides of industrially available raffinate streams. Examples of cyclic ethers comprise especially tetrahydrofuran. It will be appreciated that it is also possible to use mixtures of different alkylene oxides. According to the desired properties of the block, the person skilled in the art makes a suitable selection among the monomers and further components.

The alkylene oxide blocks (AO) may also be branched or star-shaped. Such blocks are obtainable by using starter molecules having at least 3 arms. Examples of suitable starters comprise glycerol, trimethylolpropane, pentaerythritol or ethylenediamine.

The synthesis of alkylene oxide units is known to those skilled in the art. Details are described comprehensively, for example, in "*Polyoxyalkylenes*" in Ullmann's Encyclopedia of Industrial Chemistry, $6^{th}$ Edition, Electronic Release.

The synthesis of the block copolymers (B) used in accordance with the invention can preferably be undertaken by first separately preparing the alkylene oxide blocks (AO) and reacting them in a polymer-analogous reaction with the functionalized polyisobutenes to form block copolymers (B).

The structural units for the isobutylene blocks (IB) and for the alkylene oxide blocks (AO) in this context have complementary functional groups, i.e. groups which can react with one another to form linking groups.

The functional groups of the (AO) blocks are, by their nature, preferably OH groups, but they may, for example, also be primary or secondary amino groups. OH groups are particularly suitable as complementary groups for reaction with PIBSA.

In a further embodiment of the invention, the synthesis of the blocks can also be undertaken by reacting polyisobutylenes having polar functional groups (i.e. IB blocks) directly with alkylene oxides to form (AO) blocks.

The structure of the block copolymers used in accordance with the invention can be influenced through selection of type and amount of the starting materials for the (IB) and (AO) blocks, and of the reaction conditions, especially of the sequence of addition.

The possible syntheses are described hereinafter by way of example for OH groups and succinic anhydride groups (referred to as S), without any intention that the invention thus be restricted to the use of such functional groups.

HO—[B]—OH hydrophilic blocks which have two OH groups

[B]—OH hydrophilic blocks which have only one OH group

[B]—$(OH)_x$ hydrophilic blocks having x OH groups (x≥3)

[A]-S polyisobutene with a terminal S group

S-[A]-S polyisobutene with two terminal S groups

[A]-$S_y$ polyisobutene with y S groups (y≥3)

The OH groups can, in a manner known in principle, using the succinic anhydride groups S, be linked to one another to form ester groups. The reaction can, for example, be undertaken in bulk while heating. Suitable reaction temperatures are, for example, from 80 to 150° C.

Triblock copolymers A-B-A are obtained, for example, in a simple manner by reacting one equivalent of HO—[B]—OH with two equivalents of [A]-S. This is shown by way of example hereinafter with complete formulae. One example is the reaction of PIBSA and a polyethylene glycol:

2

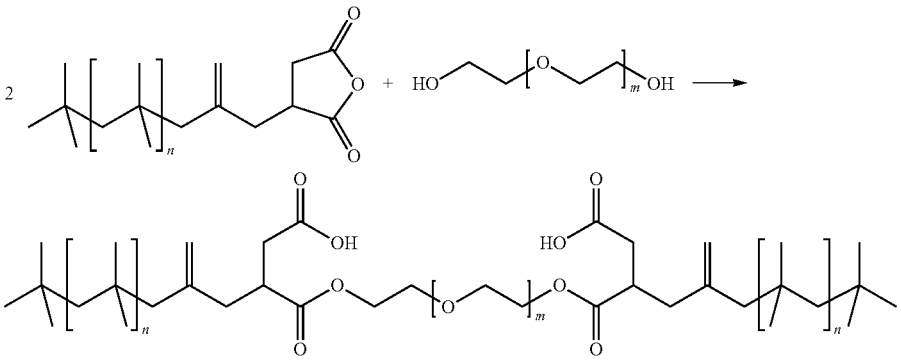

In this scheme, n and m are each independently natural numbers. They are selected by the person skilled in the art such that the block lengths defined at the outset for the (IB) and (AO) blocks are obtained.

Star-shaped or branched block copolymers $BA_x$ can be obtained by reacting [B]—$(OH)_x$ with x equivalents of [A]-S.

Block copolymers (B) which are particularly preferred for use in the process according to the invention are:

phenol alkylated with polyisobutylene, which is reacted with alkoxide, especially ethylene oxide, polyisobutylene with terminal amino groups, which is reacted with alkoxide, especially ethylene oxide, and PIBSA, which is reacted with an alkylene oxide block, especially polyethylene oxide.

For the person skilled in the art in the field of polyisobutenes, it is clear that the resulting block copolymers, according to the preparation conditions, may also still have residues of starting materials. Moreover, they may be mixtures of different products. Triblock copolymers of the formula ABA may, for example, also comprise diblock copolymers AB, and also functionalized and unfunctionalized polyisobutene. Advantageously, these products can be used for the application without further purification. However, it will be appreciated that the products can also be purified. The person skilled in the art is aware of suitable purification methods.

According to the invention, step (a) of the present invention involves the reaction in the presence of a solvent (C). Preference is given to using, as the solvent (C), at least one compound selected from the group consisting of aliphatic alcohols and aliphatic ethers. The solvent (C) is more preferably selected from ethanol, tetrahydrofuran or a mixture of ethanol and tetrahydrofuran. The solvent (C) is most preferably ethanol.

In a preferred embodiment, the reaction in step (a) is effected in the absence of water or in the presence of small amounts of water, more preferably in the absence of water. Presence of small amounts of water is understood in the context of the present invention to mean that the proportion of water in the solvent (C) is at most 5% by weight, especially at most 1% by weight.

In a preferred embodiment, the solvent (C) used is at least one compound selected from the group of the aliphatic alcohols, especially ethanol.

Step (b)

In a preferred embodiment, in step (b), the composite material (K) is applied to a substrate (S).

The transparent conductive oxide is preferably obtained in the form of a layer of layer thickness from 10 to 500 nm on a substrate (S).

Processes for applying the composite material (K) to a substrate (S) are known to those skilled in the art. Useful processes are in principle customary processes such as application by immersion (especially dip-coating), application by spraying (especially spray coating), application by evaporation of the solvent, application with rotation (especially spin-coating), and printing processes. Preference is given to the application of a coating.

Advantageous processes for applying layers are those which enable a controllable and simultaneously homogeneous layer thickness in the range from 10 to 500 nm. The composite material is preferably applied to a substrate (S) as a layer by dipping, spraying, spin-coating or printing.

Step (b) is preferably performed at a time at which the composite material (K) obtained proceeding from the starting compound (A) has not yet been converted fully, more particularly has not been crosslinked fully. A crosslinked three-dimensional network is often disadvantageous with regard to the application to a substrate. It is advantageous to apply the composite material (K) to a substrate (S) in a still free-flowing state in the presence of the solvent (C).

Step (b) is performed preferably at a temperature of from 10 to 35° C., especially from 15 to 30° C., more preferably from 20 to 25° C.

Step (b) is performed preferably at a relative air humidity of from 1 to 40%, more preferably from 5 to 30%, most preferably from 10 to 20%, at a temperature of preferably from 15 to 30° C. and more preferably from 20 to 25° C. The air humidity during step (b) can be determined, for example, with commercial hygrometers. Preference is given to impedance and capacitive hygrometers.

A higher air humidity than that specified above has been found to be disadvantageous and leads, after performance of step (c), especially to a lower adhesion of the transparent conductive oxide on the substrate and to the formation of relatively large cracks which are macroscopic under some circumstances. The term "air humidity" relates to the atmosphere surrounding the composite material (K) during step (b).

A complete or very substantial crosslinking is subsequently achieved by heat treatment in step (c).

Suitable substrates (S) are especially those which satisfy the following requirements:

thermal stability at temperatures of up to 900° C.

stability toward organic solvents oxidation stability under the conditions of steps (c) and optionally (d).

In addition, the selection of the substrate (S) is determined by the later use.

Useful substrates include especially metals, silicon wafers, glass and other polar, thermally stable surfaces, preference being given to substrates (S) based on glass, silicon, ceramic or metals.

Step (c)

According to the invention, in step (c), the composite material (K) is heated to a temperature of at least 350° C. The person skilled in the art refers to the heating of a composite material to a temperature of at least 350° C. typically as calcination. Step (c) is preferably performed in the presence of air and/or in the presence of oxygen. Calcination in the presence of oxygen leads to advantageous and complete development of a porous oxidic network.

In the process according to the invention, step (c) is preferably performed by heat treatment in at least two stages, a first stage (c1) involving exposure of the composite material (K) to a temperature of from 80 to 200° C. for from 1 to 24 hours, and a further stage (c2) involving exposure to a temperature of from 350 to 900° C. for from 1 to 5 hours.

The person skilled in the art refers to step (c1) typically as aging and to step (c2) typically as calcination. These terms are used hereinafter to characterize process steps (c1) and (c2) respectively, or, when the heat treatment is not performed in at least two stages according to the above-described preferred embodiment, the term "calcination" is used to characterize the employment of a temperature of at least 350° C.

"Aging" is understood to mean that the degree of crosslinking of the oxidic network is increased further and/or the number of reactive groups at the surface of the porous oxidic network is reduced. Preferably, in step (c1), the degree of crosslinking of the oxidic network of the composite material (K) is increased.

In the course of calcination, the block copolymer (B) is removed from the composite material (K). Furthermore, in the course of calcination, crystallinity of the transparent conductive oxide is developed or increased.

The two-stage version of step (c) is preferred especially in connection with step (b), which involves application to a substrate (S).

It has been found to be advantageous to strictly control the rise in the temperature within step (c). Slow heating is of significance especially from a temperature of 200° C., since high stresses occur in the solid in the case of excessively rapid progress of aging and crystallization, which can lead to undesired degradation of the mesostructure. Moreover, there is the risk of excessively large primary crystals if the temperature is increased too rapidly proceeding from 200° C.

Heating rates of from 0.1 K to 20 K per minute have been found to be suitable. However, it is preferred when, proceeding from a temperature of 200° C., the maximum temperature in step (c) is attained by employing a heating rate of at most 5 K/min. Below 200° C., the heating rate is less critical. It is, however, preferred to employ the abovementioned heating rates also within the temperature range of up to 200° C.

Suitable means of heat treating the composite material (K) are known to those skilled in the art and are not subject to any particular restriction, provided that they enable compliance with the abovementioned conditions. Suitable equipment is, for example, heating ovens with temperature control. It is possible, for example, to use customary high-temperature, tubular, calcining or muffle furnaces. The temperature is monitored preferably by means of suitable monitoring equipment, which enables establishment and control of start and target temperatures, of heating rates and of temperature hold times.

Step (d)

It has also been found to be advantageous, after step (c), to thermally treat the resulting specimens in the presence of an oxygen-free atmosphere, preferably consisting of nitrogen or of a mixture of nitrogen and hydrogen. In many cases, this allows the conductivity of the transparent conductive oxides to be improved further.

Accordingly, preference is given to performing, after step (c), as step (d), a thermal aftertreatment of the resulting material at a temperature of from 300 to 800° C., especially from 400 to 600° C., with exclusion of oxygen. The thermal aftertreatment is effected preferably under an atmosphere composed of nitrogen or of a mixture of nitrogen and hydrogen. The temperature may remain constant or vary within a temperature program.

Step (d) can be employed by heating the fully or partly cooled material after step (c), or the already heated material is used directly in step (d).

If step (d) is carried out, it is preferable to increase the temperature by a heating rate of at most 20 K/min, especially at most 15 K/min.

When a thermal aftertreatment is carried out after step (d), the duration of the thermal aftertreatment may vary over a long period, which may be a few minutes or several hours. Preference is given to effecting the thermal aftertreatment in step (d) over a period of from 5 minutes to 3 hours, especially from 15 minutes to 1 hour.

Use

The transparent conductive oxides obtainable in accordance with the invention are suitable, inter alia, for applications in the sector of electronics, optoelectronics, displays, touch pads, solar cells, sensors, electrode materials and electroluminescent components.

The transparent conductive oxides obtainable in accordance with the invention are preferably used in electronic components or as an electrode material or as a material for antistatic applications.

The transparent conductive oxides obtainable in accordance with the invention have a high electrical conductivity, a high transparency and an excellent homogeneity and freedom from cracks. The adhesion to substrates is very good. The layer thickness of the transparent conductive oxides obtainable in accordance with the invention is homogeneous.

EXAMPLES

Determination Methods

The electrical resistance of the films was measured by means of a 4-point method to DIN EN ISO 3915 with a digital Keithley 2000 multimeter. The specific resistivity was obtained by multiplying the resistivity by the layer thickness of the film. The electrical conductivity was calculated therefrom by forming the reciprocal.

The crystallinity was determined by means of wide-angle X-ray scattering (WAXS). The analysis was carried out on a "D8 diffractometer" from Bruker AXS GmbH, Karlsruhe (Cu—Kα radiation). The films applied to an Si wafer were analyzed in "symmetrical reflection" (θ-2θ geometry) using a "Goebel mirror" and an energy-dispersive solid phase detector from Bruker AXS (Si-based). A Soller collimator was placed in front of the detector. The measurement was carried out in steps of 0.05° between 2θ=5°-120° with a recording time of 1-5 seconds per measurement. The measurement provided the WAXS intensity against 2θ.

The analysis of the data was carried out in three stages by means of Software (Origin®): 1.) Subtraction of the constant background which was determined at the points with the highest and the lowest 2θ values of the WAXS curve; 2.) multiplication of the corrected WAXS analysis data with the square of the diffraction vector $s^2$ and of the total intensity by integration; 3.) determination of the integral intensity of the individual Bragg reflections after separation of the signals by means of the "subtract line" function such that, after subtraction, symmetrical signals were obtained and the signal base on both sides attained an intensity of zero, and formation of the sum of the integral intensities of all Bragg reflections.

The crystallinity (also known to those skilled in the art as the degree of crystallinity) can be determined from the integral intensity of the Bragg reflections and the total intensity of all reflections using the following formula:

$$\phi_{cryst} = \frac{I_{Bragg}}{I_{Bragg} + I_{amorphous}}$$

The porosity was determined by measuring the pore volume by means of ellipsometry with the UV-VIS (240 to 1000 nm, Variable Angle Spectroscopic Ellipsometer) VASE M2000-U ellipsometer from Woollam, which was equipped with a chamber for monitoring the atmospheric humidity (ellipsometric porosimetry). The porosity was determined by means of the Kelvin equation, which was adjusted with respect to water adsorption. The data analysis was carried out with the WVASE 32 analysis software (from Woollam) assuming the density of $SiO_2$. After the layer thickness had been determined, the pore volume of the layer was determined from the resulting refractive index. Finally, the real pore volume was calculated by multiplying the value obtained for $SiO_2$ with the ratio of the densities of $SiO_2$ and the TCO examined. The density used for the TCO examined was the density of the appropriate crystal polymorph of the host oxide from the database www.mindat.org. The method is described in Langmuir, 21, 26, 2005, 12362-12371 by Boissiere et al.

The specific surface area was determined by adsorption measurement of Krypton at 77K by means of the Quantachrome Autosorb 1-MP instrument.

The number-average pore size and the geometric shape of the pores were determined by means of a scanning electron microscope and subsequent image analysis on at least 500 individual pores.

The composition was determined with the aid of photoelectron spectroscopy (XPS) using the ESCALAB 250 spectrometer from Thermo VG Scientific. The measurement was effected at room temperature with a monochromatic Al Kα X-ray source at a power of 250 W. The pressure in the test chamber was adjusted to $1\times10^{-7}$ Pa. The spectra measured were resolved into their Gaussian components by means of a quadratic fitting method. The binding energies were referenced to the main signals of the host oxides (e.g. C1s signal (285.0 eV) for ATO).

The layer thickness of the films was determined by SEM measurements. The film was partly crushed and the fracture edge was analyzed.

The transparency was determined as transmission in % on quartz glass with a UV-VIS spectrometer at a path length of 200 nm and at a wavelength in the range from 380 nm to 780 nm to DIN 1349-2:1975.

Example 1

The TCO was produced by the steps listed below:

1.) 175 mg of an isobutylene-ethylene oxide diblock copolymer with a number-average block length of the isobutylene block of 108 units and a number-average block length of the ethylene oxide block of 100 units were dissolved in 3.0 ml of ethanol and 1 ml of THF by means of ultrasound until a homogeneous solution was obtained.

2.) 29.6 mg of a solution of antimony(III) ethoxide $Sb(OC_2H_5)_3$ in 4 ml of ethanol were added to 600 mg of $SnCl_4$ and the mixture was stirred for one hour.

3.) The homogeneous solution of the polymer was added to the solution of the inorganic precursor.

4.) The resulting sol was stirred for 24 h.

5.) By means of dip-coating, thin layers were produced on Si wafers and glass at a constant withdrawal speed of 6 mm/s and a relative humidity of 15%.

6.) After the films had been applied, they were heat treated at 100° C. for 12 h. Subsequently, the sample was heated to 200° C. at a heating rate of 1K/min and kept at 200° C. for 2 h. This thermal treatment consolidated the network.

7.) The sample heated to 200° C. was then heated to 300° C. at a heating rate of 1° C./min and further to 550° C. at a heating rate of 5 K/min, and then cooled to room temperature by opening the oven. This sample was used to determine the specific resistivity.

8.) After step 7), the samples were heated under an $N_2$ atmosphere and heat treated under an $N_2$ atmosphere at 450° C. for a further 30 minutes. Beginning at 25° C., the heating rate was 10 K/min until the end temperature of 450° C. was attained. Using the samples obtained in step 8), the specific resistivity, the conductivity, the crystallinity, the specific surface area by Kr physisorption, the layer thickness and the pore size were determined.

Examples 2 and 3

The preparation was effected analogously to example 1, except that the molar ratio of trivalent antimony and tetravalent tin, Sb(III)/Sn(IV), was varied according to table 1, by adding, instead of 29.6 mg, now 59.2 mg (example 2) or 78.8 mg (example 3) of a solution of antimony(III) ethoxide $Sb(OC_2H_5)_3$ in 4 ml of ethanol to 600 mg of $SnCl_4$, and stirring for one hour.

The samples from examples 1-3 all had a crystallinity of more than 90%, a porosity of approx. 35% by volume, a specific surface area in the region of 100 $m^2/g$, a transmission of 93-96% and a film thickness of approx. 200 nm.

The results of the measurements of the specific resistivities and of the conductivities are compiled in table 1.

TABLE 1

Properties of the Sb-doped $SnO_2$ films.

| Example | Molar Sb(III)/Sn(IV) ratio according to steps 1.) and 2.) [%] | Specific resistivity after step 7.) [Ω · cm] | Specific resistivity after step 8.) [Ω · cm] | Conductivity after step 8) [S · cm$^{-1}$] | Crystallinity | Porosity [% by vol.] | Specific area (Kr physisorption) [m$^2$/g] |
|---|---|---|---|---|---|---|---|
| 1 | 5.0 | $8.86\times10^{-2}$ | $4.92\times10^{-2}$ | 20.3 | >90% | approx. 35 | approx. 100 |
| 2 | 10.0 | $8.96\times10^{-2}$ | $4.22\times10^{-2}$ | 23.7 | >90% | approx. 35 | approx. 100 |
| 3 | 15.0 | $7.70\times10^{-2}$ | $3.98\times10^{-2}$ | 25.1 | >90% | approx. 35 | approx. 100 |

| Example | Number-average pore size after step 7.) [nm] | Number-average pore size after step 8) [nm] | Transmission 380-780 nm [%] | Layer thickness of the film [nm] | Molar Sb(III)/Sn(IV) ratio [%] after step 8.) (XPS) |
|---|---|---|---|---|---|
| 1 | 20-25 | 20-25 in film plane and 13 at right angles to the film | 93-96 | 200 | nd |
| 2 | 20-25 | 20-25 in film plane and 13 at right angles to the film | 93-96 | 200 | nd |

TABLE 1-continued

| Properties of the Sb-doped $SnO_2$ films. | | | | | |
|---|---|---|---|---|---|
| 3 | 20-25 | 20-25 in film plane and 13 at right angles to the film | 93-96 | 200 | 12.9 |

nd = not determined

The adhesion and stability of the films according to examples 1, 2 and 3 on the substrate was excellent and no abrasion by finger was possible. The films were crack-free and had a homogeneous layer thickness.

Examples 4 and 5

Preparation of Nb- and Ta-doped $SnO_2$

TABLE 2

| | Example | |
|---|---|---|
| | 4 | 5 |
| Niobium n-propoxide $Nb(OC_3H_7)_5$ [mg] | 37 | — |
| Tantalum isopropoxide $Ta(OC_3H_7)_5$ [mg] | — | 51 |
| Molar Nb(V) or Ta(V) to Sn (IV) ratio [%] | 4.5 | 5.0 |

Solutions of the amounts of $Nb(OC_3H_7)_5$ or $Ta(OC_3H_7)_5$ specified in table 2 in 2 ml of ethanol were added to 550 mg of $SnCl_4$ and then stirred for 4 h (solution of starting compound (A)). 120 mg of an isobutylene-ethylene oxide diblock copolymer with a number-average block length of the isobutylene block of 108 units and of a number-average block length of the ethylene oxide block of 100 units were dissolved in 4 ml of ethanol (concentration: 3.66% by weight) and treated with ultrasound until a homogeneous solution was obtained. The homogeneous solution of the polymer was mixed with the solution of the starting compound (A) and stirred for 19 h. A transparent sol was obtained.

By means of dip-coating, thin films were produced on Si wafers and glass substrates at a constant withdrawal speed of the wafer of 6 mm/s and a relative air humidity of 11-15% (20° C.). After the application of the film, it was treated successively at 100° C. for 10 h and, after increasing the temperature to 200° C. within 100 minutes, at this temperature for 2 h. The sample thus obtained was heated to 300° C. at a heating rate of 1 K/min and treated at this temperature for 2 h. Subsequently, the sample was heated to 550° C. or 650° C. at a heating rate of 5 K/min and cooled to room temperature by opening the oven. This sample was used to determine the specific resistivity (according to step 7.). Subsequently, the samples were heat treated further at 450° C. under an $N_2$ atmosphere for 30 minutes (corresponding to step 8.). Beginning at 25° C., the heating rate was 5 K/min until the temperature of 450° C. was attained. The samples thus obtained were used to determine the specific resistivity, the conductivity, the layer thickness and the pore size.

The samples from examples 4 and 5 had a specific surface area in the region of 100 $m^2/g$, a transmission of 91-95% and a film thickness of approx. 200 nm. The adhesion of the films on the substrate was excellent and no abrasion by finger was possible. The films were crack-free and homogeneous in layer thickness. The number-weighted mean pore size of the films after calcination was 20-25 nm parallel to the film and 10-15 nm at right angles to the film direction.

The results of the measurements of the specific resistivities and of the conductivities are compiled in table 3.

TABLE 3

| Properties of the Nb- and Ta-doped $SnO_2$ films. | | | | |
|---|---|---|---|---|
| Example | Specific resistivity after step 7.) [Ω · cm] | Conductivity after step 7.) [$S \cdot cm^{-1}$] | Specific resistivity after step 8.) [Ω · cm] | Conductivity after step 8.) [$S \cdot cm^{-1}$] |
| 4 (550° C.) | $1.45 \times 10^0$ | 0.7 | $1.97 \times 10^{-1}$ | 5.1 |
| 4 (650° C.) | $2.26 \times 10^{-1}$ | 4.4 | $3.10 \times 10^{-1}$ | 3.2 |
| 5 (550° C.) | $2.26 \times 10^{-1}$ | 4.4 | $7.38 \times 10^{-2}$ | 13.6 |
| 5 (650° C.) | $6.90 \times 10^{-1}$ | 1.4 | $1.02 \times 10^{-1}$ | 9.8 |

Comparative Example C6

1.04 g of decethylene oxide octadecyl ether $C_{18}H_{37}$—O-$(EO)_{10}$ from Sigma-Aldrich Chemie GmbH (Brij 76) were dissolved in 10 g of ethanol. Subsequently, 2.66 g of $SnCl_4$ and 0.15 g of $SbCl_3$ were added and the mixture was stirred for 30 min. The solution was filtered. For the subsequent dip-coating, both cleaned glass wafers and cleaned Si wafers were used as the substrate. The speed at which they were pulled out was 2 mm/s.

After the dip-coating, the coated plates (Si and glass) were placed into an oven at 60° C. and 20% relative humidity for 10 h. Subsequently, the relative air humidity was increased to 80% and the plates were left in the oven at 40° C. for a further 60 minutes. After cooling, the coated plates were left to stand under air for 150 h. Subsequently, the plates were once again placed into the oven at 40° C. and 20% relative humidity for 1 h.

The electrical conductivity of the resulting films was in the order of magnitude of 20 megaohms. The films were thus electrically insulating (nonconductive). The films were cracked and, after drying, flaked off the substrate in places. The films were additionally opaque, i.e. they had a low transparency. The adhesion on the substrate was inadequate. The films were noncrystalline according to X-ray diffraction.

The invention claimed is:

1. A process for preparing transparent conductive oxides, comprising the following steps in the sequence of a-b-c:

(a) reaction of at least one starting compound (A) comprising at least one metal or semimetal M and optionally of a dopant (D) comprising at least one doping element M', where at least one M' is different than M, in the presence of a block copolymer (B) and of a solvent (C) to form a composite material (K), (b) optional application of the composite material (K) to a substrate (S) and (c) heating of the composite material (K) to a temperature of at least 350° C., wherein the block copolymer (B) comprises at least one alkylene oxide block (AO) and at least one isobutylene block (IB).

2. The process according to claim 1, wherein the block copolymer (B) comprises at least one alkylene oxide block (AO) and at least one isobutylene block (IB), where the number-weighted mean block length of the alkylene oxide block (AO) is from 4 to 300 monomer units and the number-weighted average block length of the isobutylene block (IB) is from 5 to 300 monomer units.

3. The process according to claim 1, wherein the reaction in step (a) is performed in the presence of at least one diblock copolymer (B) consisting of an alkylene oxide block (AO) and an isobutylene block (IB).

4. The process according to claim 1, wherein the block copolymer (B) has a polydispersity index of from 2 to 20.

5. The process according to claim 1, wherein the transparent conductive oxide is mesoporous.

6. The process according to claim 1, wherein the transparent conductive oxide is crystalline, crystalline meaning that the proportion by mass of crystalline transparent conductive oxide relative to the total mass of transparent conductive oxide is at least 60%, determined by means of wide-angle X-ray scattering.

7. The process according to claim 1, wherein the starting compound (A) comprises at least one metal or semimetal M selected from Sn, Zn, In and Cd.

8. The process according to claim 1, wherein the reaction in step (a) is carried out in the presence of a dopant (D) comprising at least one doping element M', where at least one M' is different than M.

9. The process according to claim 8, wherein the dopant (D) comprises at least one doping element M' selected from Al, Ga, B, Sb, Cd, Sn, In, Ta, Nb and F.

10. The process according to claim 1, wherein the starting compound (A) comprises tin as the metal or semimetal M, and a dopant (D) comprising antimony as the doping element M' is used.

11. The process according to claim 1, wherein the proportion of water in the solvent (C) is at most 1% by weight.

12. The process according to claim 1, wherein the solvent (C) used is at least one compound selected from the group of the aliphatic alcohols.

13. The process according to claim 1, wherein step (c) is performed by heat treatment in at least two stages, a first stage (c1) involving exposure to a temperature of from 80 to 200° C. for from 1 to 24 hours, and a further stage (c2) exposure to a temperature of from 400 to 900° C. for from 1 to 5 hours.

14. The process according to claim 1, wherein, proceeding from a temperature of 200° C., the maximum temperature in step (c) is attained by employing a heating rate of at most 5 K/min.

15. The process according to claim 1, wherein step (c) is followed, as step (d), by a thermal aftertreatment of the resulting material at a temperature of from 300 to 800° C. with exclusion of oxygen.

16. The process according to claim 1, wherein the transparent conductive oxide is obtained as a layer of layer thickness from 10 to 500 nm on a substrate (S).

17. A transparent conductive oxide obtained according to claim 1.

18. An electronic component comprising a transparent conductive oxide according to claim 17.

19. The use of the transparent conductive oxides according to claim 17 in electronic components or as an electrode material or as a material for antistatic applications.

20. The process according to claim 6, wherein the proportion by mass of crystalline transparent conductive oxide relative to the total mass of transparent conductive oxide is at least 70%, determined by means of wide-angle X-ray scattering.

21. The process according to claim 6, wherein the proportion by mass of crystalline transparent conductive oxide relative to the total mass of transparent conductive oxide is at least 80%, determined by means of wide-angle X-ray scattering.

22. The process according to claim 6, wherein the proportion by mass of crystalline transparent conductive oxide relative to the total mass of transparent conductive oxide is at least 90%, determined by means of wide-angle X-ray scattering.

23. The process according to claim 12, wherein the solvent (C) used is ethanol.

* * * * *